US006505904B1

(12) United States Patent
Hirayama

(10) Patent No.: US 6,505,904 B1
(45) Date of Patent: Jan. 14, 2003

(54) PRINTHEAD AND PRINTING APPARATUS USING THE SAME

(75) Inventor: Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 09/640,061

(22) Filed: Aug. 17, 2000

(30) Foreign Application Priority Data

Aug. 20, 1999 (JP) ..... 11-234541

(51) Int. Cl.[7] ..... B41J 29/38
(52) U.S. Cl. ..... 347/14
(58) Field of Search ..... 347/14, 17, 48, 347/50, 54, 55, 56–59; 400/120.14, 124.13, 74

(56) References Cited

U.S. PATENT DOCUMENTS

| | | | |
|---|---|---|---|
| 4,313,124 A | 1/1982 | Hara | |
| 4,345,262 A | 8/1982 | Shirato et al. | |
| 4,459,600 A | 7/1984 | Sato et al. | |
| 4,463,359 A | 7/1984 | Ayata et al. | |
| 4,558,333 A | 12/1985 | Sugitani et al. | |
| 4,723,129 A | 2/1988 | Endo et al. | |
| 4,740,796 A | 4/1988 | Endo et al. | |
| 5,764,246 A | 6/1998 | Wataya et al. | |
| 5,851,075 A | 12/1998 | Imai | 400/120.14 |

FOREIGN PATENT DOCUMENTS

| | | |
|---|---|---|
| EP | 0 980 758 | 2/2000 |
| EP | 1 078 752 | 2/2001 |
| GB | 2 330 798 | 5/1999 |
| JP | 59-123670 | 7/1984 |
| JP | 59-138461 | 8/1984 |
| JP | 6-336071 | 12/1994 |

*Primary Examiner*—John Barlow
*Assistant Examiner*—K. Feggins
(74) *Attorney, Agent, or Firm*—Fitzpatrick, Cella, Harper & Scinto

(57) ABSTRACT

A printhead having a temperature detection circuit on its substrate capable of temperature detection with higher accuracy and at a lower cost, and a printing apparatus using the printhead. In the printhead, the temperature detection circuit is integrated on the substrate where a printhead driving circuit is integrated. The temperature detection circuit generates and amplifies a temperature-independent bandgap voltage as a reference voltage, generates a thermal voltage proportional to an absolute temperature, compares the thermal voltage with the reference voltage, and outputs the result of comparison as digital binary data.

8 Claims, 7 Drawing Sheets

PRINTHEAD AND PRINTING APPARATUS USING THE SAME

FIELD OF THE INVENTION

The present invention relates to a printhead and a printing apparatus using the printhead, and more particularly, to a printhead for performing printing in accordance with an ink-jet method and a printing apparatus using the printhead.

BACKGROUND OF THE INVENTION

In printers using an ink-jet printhead to print an image by discharging ink, to perform high-quality printing, it is desirable to uniformly maintain the size of ink droplets, since there might be degradation of image quality due to ink droplets in non-uniformed sizes or due to density unevenness caused by such ink droplets.

Among the ink-jet printheads, in a printhead which heats ink so as to form a bubble and discharge an ink droplet by the pressure of the bubble, the size of ink droplet is influenced by the ink viscosity and the pressure upon bubble formation. As the ink viscosity and the bubble pressure depend on the temperature of the ink, when the temperature changes, the size of ink droplet also changes. As a result, the quality of print image may be degraded.

Accordingly, conventional print control is detecting the ink temperature, changing a pulsewidth to be applied to the heater so as to control discharge energy, thus maintaining a predetermined size of ink droplets. Further, another control is detecting an abnormal temperature rise which may damage the printhead during a high-speed printing operation, and suspending the printing operation.

Japanese Patent Laid-open Publication No. 6-336071 proposes temperature detection means for such control. The temperature of printhead is detected by amplifying a forward voltage ($V_F$) from a diode integrated on the substrate of the printhead by analog signal processing outside the printhead, then performing correction on fluctuations in the forward voltage ($V_F$), and reading a $V_f$ temperature coefficient.

FIG. 6 is a block diagram showing the construction of a conventional temperature detection circuit capable of correcting fluctuations in output from a diode sensor.

As shown in FIG. 6, a voltage applied to a diode 102 on a substrate of a printhead 101 from a constant-voltage power supply 103 is inputted as a forward voltage ($V_F$) into a (−) terminal of a differential amplifier 104 constructing an analog signal processing circuit outside the printhead. The output from the differential amplifier 104 is inputted into a (+) terminal of a comparator 105. On the other hand, a signal indicating a predetermined threshold value, outputted from a CPU 106, and converted by a D/A converter 108 into an analog signal, is inputted into a (−) terminal of the comparator 105. The output from the comparator 105 is inputted into an A/D input terminal 109 of the CPU 106.

On the other hand, as the CPU 106 includes an A/D converter, the analog signal inputted into the A/D input terminal 109 is converted into a digital value and is processed by the CPU 106. Further, as the printing apparatus has a temperature sensor 107 for detecting its internal temperature, the output from the sensor is inputted into an A/D input terminal 110.

In this construction, the CPU 106 performs print control based on the temperature information detected by the diode in the printhead 101.

However, in the above conventional art, as the temperature is detected by the signal processing circuit outside the printhead by using the forward voltage ($V_F$) from the diode on the substrate of the printhead, there are following problems to be solved.

(1) The diode of the printhead and the analog signal processing circuit are electrically connected to each other via a flexible cable and connectors, and the same flexible cable includes signal and power source lines for driving the printhead. Digital noise from the adjacent signal line and noise from the power source line may mix with the signal from the diode, producing an error in the forward voltage ($V_F$) to cause error in the detected temperature.

(2) As a heater driver for the printhead is also integrated on the semiconductor substrate where the diode is integrated, the fluctuations in a heater drive current become ground potential fluctuations due to the impedance of the ground of the substrate. Accordingly, the ground potential of the diode on the same substrate fluctuates. If the ground potential of the temperature detection circuit is different from that of the substrate of the printhead, there may be an error in the detection of the forward voltage ($V_F$) as in the case of the above-described noise.

(3) The variations in characteristic of diodes of respective printheads and the variations in characteristic of the analog signal processing circuits also cause a similar error.

Upon occurrence of such detection temperature error, ink discharge control in accordance with ink temperature cannot be performed, and as a result, the quality of print image is degraded.

On the other hand, as the conventional temperature detection, an analog voltage as a temperature change of the forward voltage ($V_F$) is inputted into an A/D converter of a control circuit of the printer main body and is converted to a digital value, and the temperature is calculated from the change amount, based on a table showing the relationship between a temperature and a change amount pre-stored in a ROM of the control circuit. For this purpose, the A/D converter that must be provided in the control circuit and the analog processing circuit that must be provided outside the printhead complicates the apparatus construction, and increase the costs of the apparatus.

SUMMARY OF THE INVENTION

Accordingly, it is an object of the present invention to provide a printhead, having a temperature detection circuit on its substrate, capable of temperature detection at a lower cost and with higher accuracy, and a printing apparatus using the printhead.

According to one aspect of the present invention, the foregoing object is attained by providing a printhead comprising: a driving circuit that drives printing elements; and a detection circuit that detects a temperature and outputs information on the temperature as digital output, wherein the driving circuit and the detection circuit are integrated on the same semiconductor substrate, wherein the detection circuit includes: a first circuit that generates a temperature-independent bandgap voltage; a second circuit that amplifies the bandgap voltage generated by the first circuit and generates a reference voltage; a third circuit that generates a thermal voltage proportional to an absolute temperature; and a fourth circuit that compares the thermal voltage with the reference voltage, and outputs the result of comparison as binary data.

In the printhead, preferably, the second circuit includes plural resistors serially connected to an output of the reference voltage so as to output plural different voltages among the plural resistors. Preferably, the plural different voltages are sequentially selected and outputted to the fourth circuit.

Further, preferably, the printhead further comprising: a fifth circuit that corrects the reference voltage and the thermal voltage; and holding means for holding information corrected by the fifth circuit. For example, the holding means includes a fuse ROM.

Note that it is preferable that the printhead is an ink-jet printhead that performs printing by discharging ink. In this case, the printhead has electrothermal transducers to generate thermal energy to be supplied to the ink for discharging the ink by utilizing the thermal energy.

According to another aspect of the present invention, the foregoing object is attained by providing a printing apparatus which performs printing by using the printhead having the above construction.

In accordance with the present invention as described above, the temperature detection circuit is integrated on the substrate where the printhead driver is integrated, and the temperature information is outputted as digital data from the detection circuit. More specifically, a bandgap voltage independent of temperature is generated, amplified and utilized as a reference voltage, and a thermal voltage proportional to a absolute temperature is generated. The thermal voltage and the reference voltage are compared with each other, and the result of comparison is outputted as digital binary data.

The invention is particularly advantageous since the detection circuit to detect the temperature and output the temperature information as digital data is provided on the substrate where the printhead driver is provided. In this construction, it is not necessary to provide an analog signal processing circuit outside the printhead as in the conventional art. Thus, the circuit construction for temperature detection can be simplified and provided at a lower cost.

The detection circuit has a circuit to compare the reference voltage generated based on the temperature-independent bandgap voltage and the thermal voltage proportional to the absolute temperature obtained by using a current generated in the circuit to generate the bandgap voltage, and outputs the result of comparison as a binary digital value. As a result, as the temperature information processing circuit and the temperature detection circuit are provided on the same substrate, the construction can contribute to reducing the detection temperature error due to fluctuations in the substrate potential derived from the operation of the driver upon printing operation. Further, as the temperature information is outputted as digital information, noise tolerance against noise caused by wiring or the like can be increased.

Further, the detection error due to variations in device characteristic and circuit characteristic can be minimized by providing a correction circuit.

Further, as the printhead holds the correction information, the printing apparatus using the printhead omits correction processing.

In this manner, the temperature detection can be performed with higher accuracy, and print control can be performed more appropriately based on the temperature.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
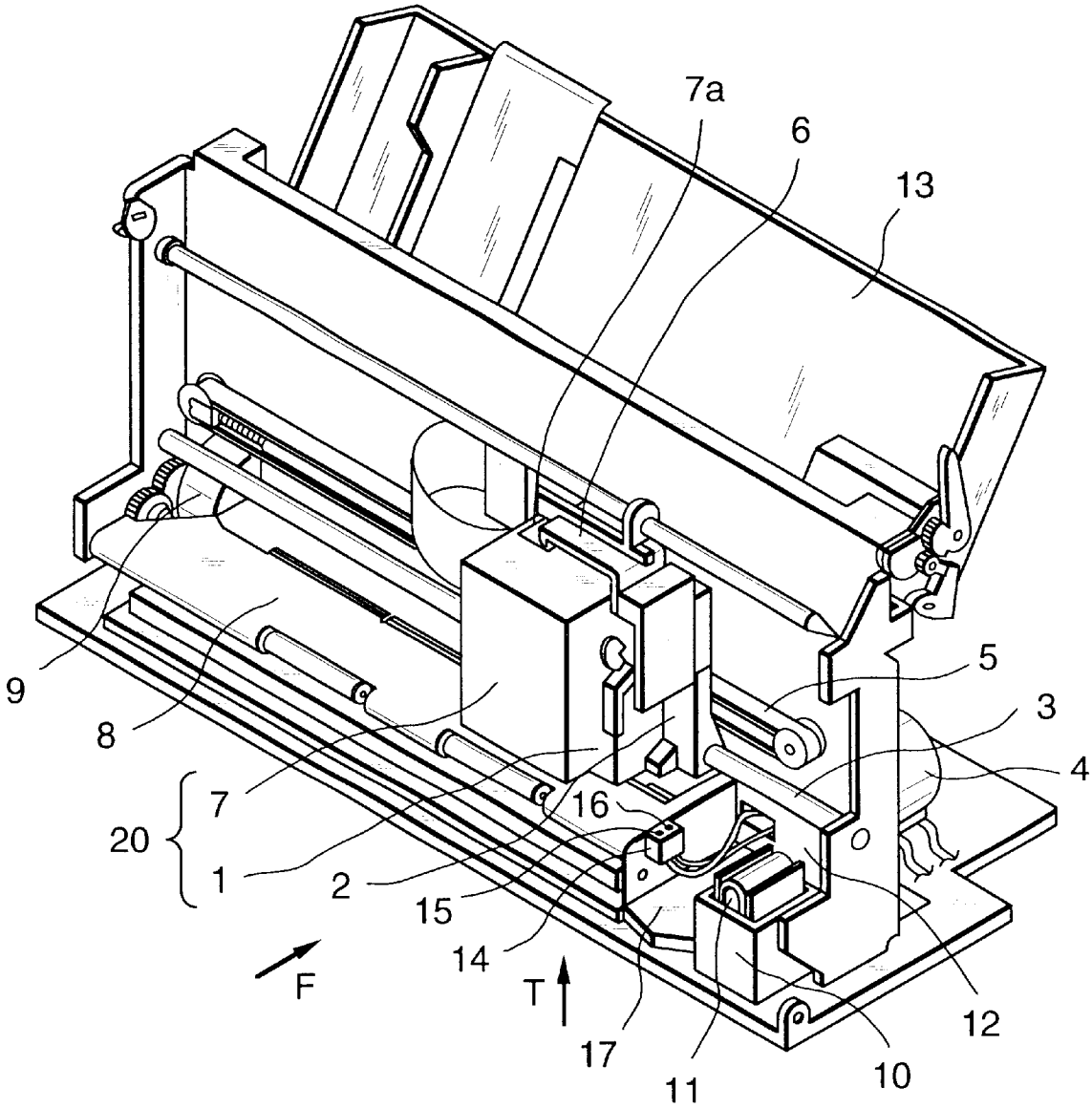
FIG. 1 is a perspective view showing a schematic construction of a printing apparatus including a printhead for performing printing in accordance with an ink-jet printing method, as a typical embodiment of the present invention.

FIG. 1 is a perspective view showing a schematic construction of a printing apparatus, as a typical embodiment of the present invention, which includes a printhead for performing printing in accordance with an ink-jet printing method.

In the present embodiment, a printhead 1 connected with an ink tank 7 which supplies ink thereto construct an ink cartridge 20 as shown in FIG. 1. Note, in the present embodiment, although the ink cartridge 20 is configured such that the printhead 1 and ink tank 7 are separable, an ink cartridge where a printhead and ink tank are integrated as a unit may be used.

On the bottom surface of the ink tank 7, a prism for detecting existence/absence of ink is provided.

Referring to FIG. 1, the printhead 1 is attached to a carriage 2 in the manner such that the printhead discharges ink downward in FIG. 1. While the carriage 2 moves along a guide 3, the printhead 1 discharges ink droplets to form an image on a print medium (not shown) e.g. print paper. Note that the lateral movement (reciprocal movement) of the carriage 2 is realized by rotation of a carriage motor 4 via a timing belt 5. The carriage 2 has an engagement latch 6 which engages with an engagement slot 7*a* of the ink tank, fixing the ink tank 7 to the carriage 2.

Upon completion of one scan by the printhead, the printing operation is suspended, a print medium positioned on a platen 8 is conveyed a predetermined amount by driving a feed motor 9, and image forming for the subsequent scan is performed by moving the carriage 2 along the guide 3.

On the right side of the main body of the printing apparatus, a recovery device 10 which performs recovery operation for maintaining a good ink discharge condition is provided. The recovery device 10 includes a cap 11 for capping the printhead 1, a wiper 12 for wiping the ink discharge surface of the printhead 1, and a suction pump (not shown) for sucking ink from the ink discharge nozzle of the printhead 1.

The driving force of the feed motor 9 for conveying a print medium is normally transmitted not only to the print medium conveyance mechanism but also to an automatic sheet feeder (ASF) 13.

Thus, upon completion of printing on one page of a printing medium such as a print paper, the feed motor 9 is driven so as to discharge the print paper to outside of the printing apparatus. In a case where printing still continues for a next print paper, the ASF 13 is also driven so as to feed the next print paper to the ASF 13 from accumulated print papers.

Moreover, on the side of the recovery device 10, an optical unit 14, consisting of an infrared LED (light emission device ) 15 and phototransistor (photoreceptor) 16, is provided for detecting existence/absence of ink. These light emission device 15 and photoreceptor 16 are arrayed in the conveyance direction of a print medium (direction indicated by the arrow F). The optical unit 14 is attached to a chassis 17 of the main body of the printing apparatus. When the ink cartridge 20 is mounted on the carriage 2 and the carriage 2 moves to the right from the position shown in FIG. 1, the ink cartridge 20 comes to the position above the optical unit 14. In this position, it is possible to detect the existence of ink in an ink tank 7 from the bottom of the ink tank by using the optical unit 14.

Next, the configuration for executing print control of the above-described apparatus will be described.

Figure 2:
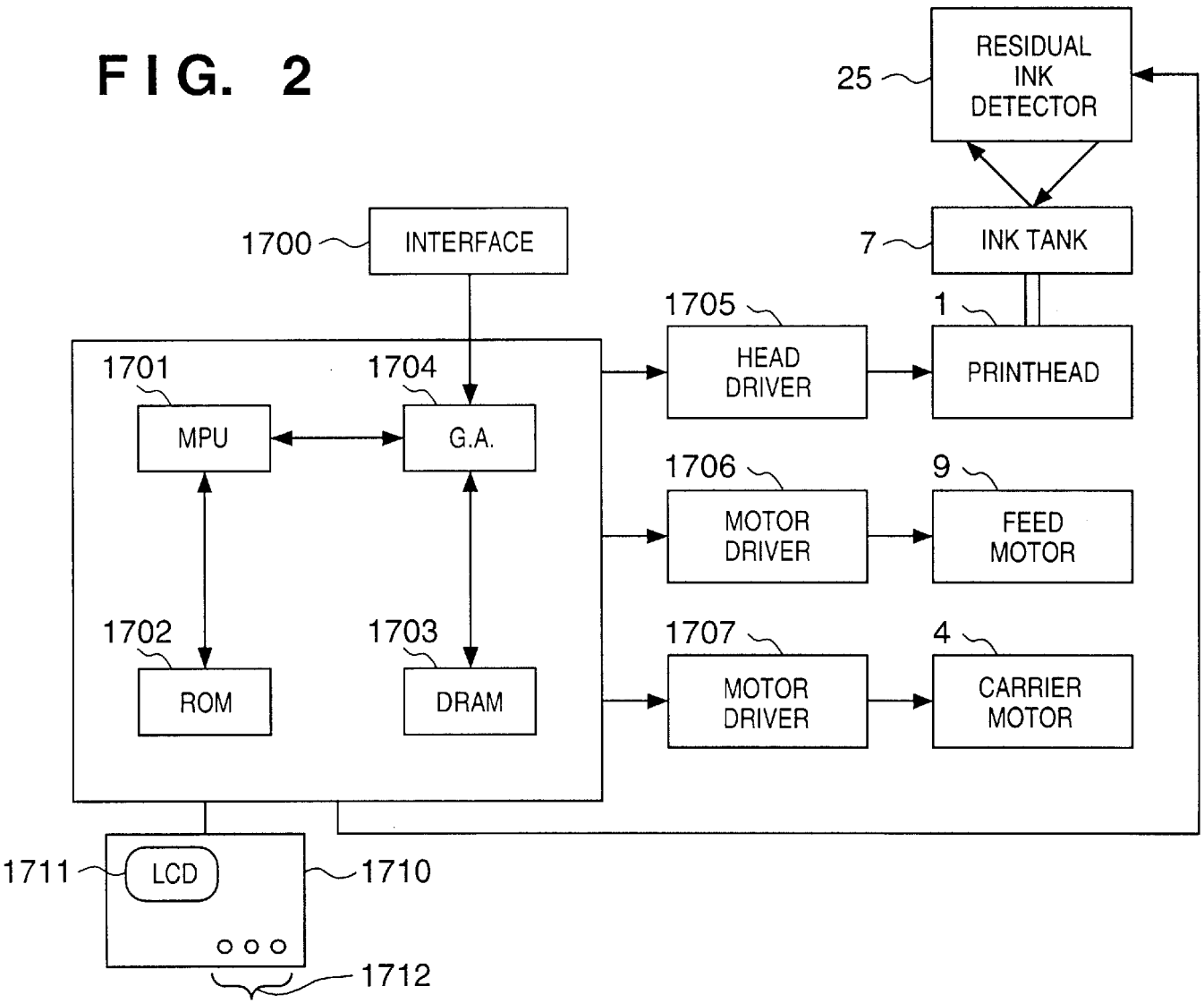
FIG. 2 is a block diagram showing the structure of a control circuit of the printing apparatus.

FIG. 2 is a block diagram showing the structure of a control circuit of the printing apparatus.

In FIG. 2, reference numeral 1700 denotes an interface for inputting a print signal; 1701, an MPU; 1702, a ROM for storing control programs to be executed by the MPU 1701; and 1703, a DRAM for storing various data (aforementioned print signal, print data supplied to the printhead 1 and so on). Reference numeral 1704 denotes a gate array (G.A.) which controls supplying print data to the printhead 1, and also controls data transfer among the interface 1700, MPU 1701 and RAM 1703. Reference numeral 1705 denotes a head driver for driving the printhead 1; 1706 and 1707, motor drivers for driving the feed motor 9 and carriage motor 4 respectively.

The operation of the foregoing control structure will now be described. When the interface 1700 receives a print signal, the print signal is converted to print data for printing between the gate array 1704 and the MPU 1701. Then, as the motor drivers 1706 and 1707 are driven, the printhead 1 is driven in accordance with the print data transmitted by the head driver 1705, performing printing.

Note that reference numeral 1710 denotes a display portion comprising an LCD 1711 which displays various messages related to a condition of printing operation or the printing apparatus, an LED lamp 1712 including various colors for informing the conditions of printing operation or the printing apparatus, and a buzzer (not shown) which emits an alarm sound.

Moreover, the MPU 1701 controls the operation of an ink existence/absence detection unit 25 which detects ink existence/absence in the ink tank 7 integrated with the printhead.

Figure 7A:
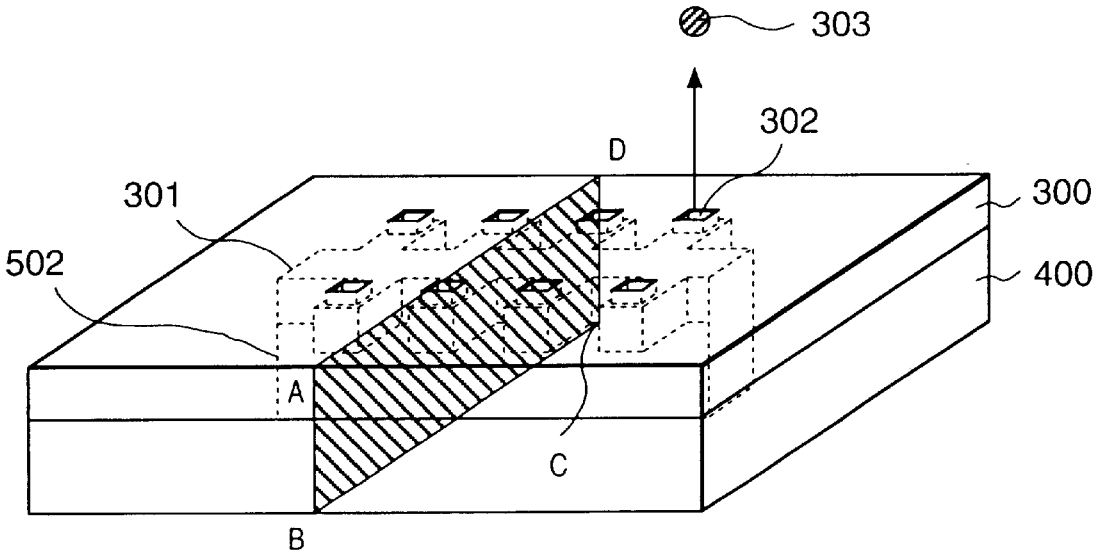
FIGS. 7A and 7B are schematic diagrams showing an ink discharge portion of an ink-jet printhead according to the present invention.
Figure 7B:
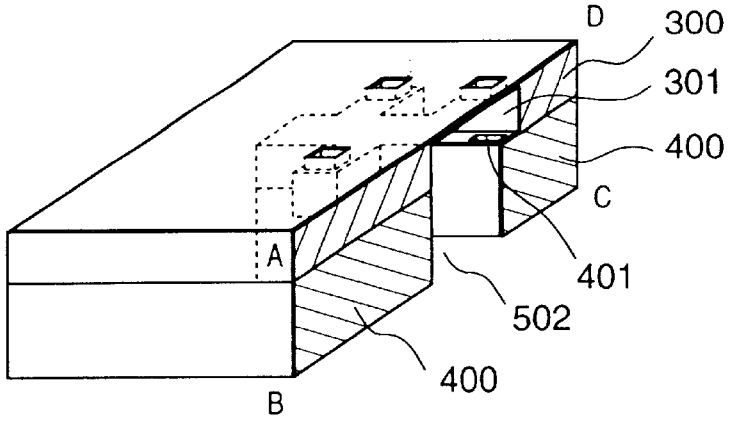

FIGS. 7A and 7B are schematic diagrams showing an ink discharge portion of the ink-jet printhead according to the present invention. FIG. 7B shows a cross section cut along an area ABCD in FIG. 7A.

Briefly, the ink discharge portion of the ink-jet printhead has a device substrate (element substrate) 400 of semiconductor such as silicon, holding plural heat generating elements (electrothermal transducers) 401 to generate heat to discharge ink 303, and an orifice member 300 provided on the device substrate 400, having discharge orifices opposite to the respective heat generating elements 401 and a groove of ink channel 301 to supply ink to the discharge orifices.

Further, the device substrate 400 has an ink supply hole 502 as a through hole to supply ink to the ink channel from the rear surface side of the device substrate. Further, driving circuits to selectively drive the respective heat generating elements 401 and wiring are integrally formed on the device substrate (chip) by semiconductor manufacturing process, and the above-described temperature sensor comprising a diode and a circuit to be described later are integrated on the device substrate.

Figure 3:
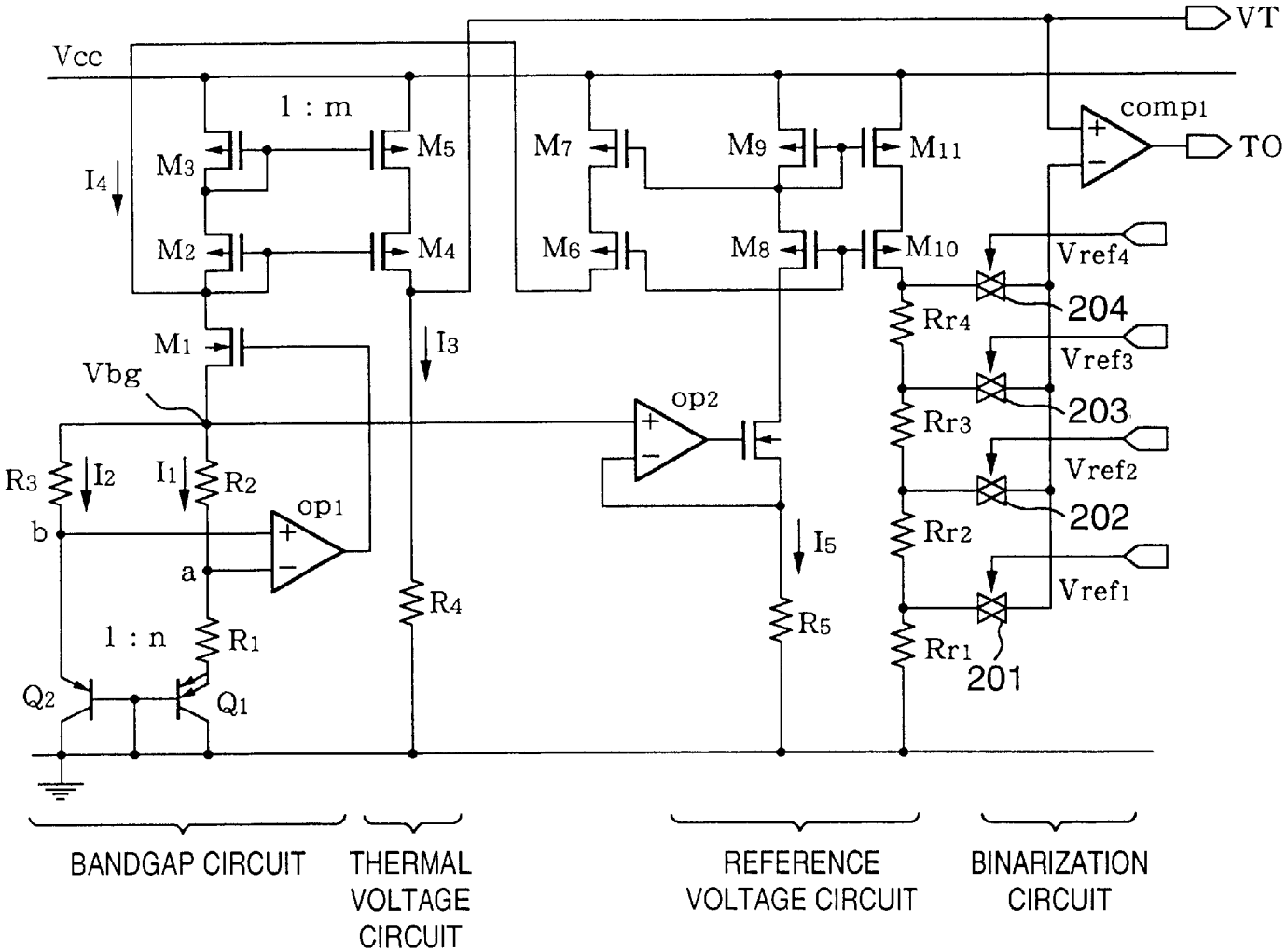
FIG. 3 is a circuit diagram showing the construction of a temperature detection circuit included in the printhead.

FIG. 3 is a circuit diagram showing the construction of a temperature detection circuit integrated on the device substrate of the printhead 1 by substrate formation using the semiconductor manufacturing process. This circuit is preferably manufactured especially by a CMOS semiconductor process. As shown in FIG. 3, the temperature detection circuit comprises a bandgap circuit, a thermal voltage circuit, a reference voltage circuit and a binarization circuit.

Note that driving circuits such as power transistors to drive the electrothermal transducers of the printhead, a shift register storing print data to drive the transistors and latch circuits, in addition to the temperature detection circuit, are integrated on the device substrate of the printhead. Since these driving circuits are well known, the explanations of the circuits will be omitted.

Transistors $Q_1$ and $Q_2$ diode-connected in the bandgap voltage source are substrate-PNP-transistors in which a substrate parasitic to a N-well region functions as a collector in use of P-type semiconductor substrate.

Next, the operation of the bandgap voltage source will be described below.

As a difference voltage $\Delta V_{be}$ of voltages $V_{be}$ of the two transistors $Q_1$ and $Q_2$ having different current densities has a positive temperature characteristic, a bandgap voltage $V_{bg}$ which is independent of temperature is obtained by performing addition on the voltage $\Delta V_{be}$ in correspondence with the slope of the voltage $V_{be}$ having a negative temperature characteristic.

Assuming that the circuits as shown in FIG. 3 have stabilized points, the voltage drop of resistors R2 and R3 in points a and b are equal to each other, $I_1R_2=I_2R_3$ and $I_1/I_2=R_3/R_2$ hold.

Assuming that $R_3$ and $R_2$ are equal to each other, $I_1=I_2$ holds.

An operational amplifier $OP_1$ provides feedback to the bandgap voltage $V_{bg}$ via the source follower of NMOS transistor $M_1$ to obtain the same potential in the points a and b.

Assuming that the emitter size ratio of the transistors $Q_1$ and $Q_2$ is n:1, the difference voltage $\Delta V_{be}$ between the voltages $V_{be}$ of the transistors $Q_1$ and $Q_2$, in a case where the base current is ignored, is expressed by $$\Delta V_{be}=V_{be2}-V_{be1}=V_t \ln\{(I_{s1}/I_{s2})\cdot(I_2/I_1)\}=V_t \ln\{nR_2/R_3\}=V_t \ln(n).$$

Note that $V_t=kT/q$ holds. As the voltage drop of resistor $R_1$ is $\Delta V_{be}$, $$I_1=\Delta V_{be}/R_1=(V_t/R_1)\ln(n) \text{ holds,}$$

further, the voltage drop of the resistor $R_2$ is expressed by $$I_1\cdot R_2=(R_2/R_1)V_t \ln(n)$$

Accordingly, the bandgap voltage $V_{bg}$ is expressed by $$V_{bg}=V_{be2}+(R_2/R_1)V_t \ln(n)=V_{be2}+aVt.$$

Note that $a=(R_2/R_1)\ln(n)$ holds.

Here, if n is a constant, T is an absolute temperature, and the resistors are of the same type and have the same temperature coefficient, a is a constant.

In the present embodiment, the temperature coefficient of the voltage $V_{be}$ is about −2.1 mV/C°. As the temperature coefficient of the voltage Vt is about 0.085 mV/C°, the temperature coefficient of the voltage $V_{bg}$ can be approximately "0" by setting the constant n and the resistor values such that the value of the multiplier a of the voltage Vt is 24.3. At this time, the voltage $V_{bg}$ is about 1.25 V.

Based on the bandgap voltage ($V_{bg}$), reference voltages ($V_{ref1}$ to $V_{ref4}$) not exhibiting temperature characteristic (temperature dependency) are set in the reference voltage circuit.

The bandgap voltage ($V_{bg}$) is applied to a resistor $R_5$ through an operational amplifier $OP_2$, and a current flowing through the resistor $R_5$ by a current mirror constructed with PMOS transistors $M_8$, $M_9$, $M_{10}$ and $M_{11}$ is mirrored to the side of resistors $R_{r1}$ to $R_{r4}$. Accordingly, the reference voltages $V_{ref1}$ to $V_{ref4}$ are set by resistance ratio and mirror ratio among the resistor $R_5$ and the resistors $R_{r1}$ to $R_{r4}$.

On the other hand, as the thermal voltage $V_T$ amplifies the difference voltage $\Delta V_{be}$ generated in the bandgap voltage source so as to obtain a voltage proportional to the absolute temperature. The voltage is shifted by using the voltage $V_{bg}$ such that the thermal voltage $V_T$ has a sufficient dynamic range with respect to the power source voltage.

A current obtained by subtracting a current $I_4$ from the current ($I_1+I_2$) in the bandgap voltage source is supplied by a current mirror constructed with MOS transistors $M_2$ to $M_5$, in the mirror ratio of 1:m, to the resistor $R_4$.

Note that as a current $I_3$ is expressed by $$I_3=m(I_1+I_2-I_4),$$

if $R_2=R_3$ holds, the current $I_3$ is expressed by $$I_3=m(2I_1-I_4)=(2m/R_1)V_t \ln(n)-mI_4.$$

Accordingly, the voltage drop $V_T$ of the resistor $R_4$ is expressed by $$V_T=I_3\cdot R_4=(2mR_4/R_1)V_t \ln(n)-mI_4R_4.$$

The current $I_4$ is a mirror current which flows through the resistor $R_5$. Assuming that the mirror ratio of a current mirror circuit constructed with MOS transistors $M_6$ to $M_9$ is 1:L, $$I_4=L\cdot V_{bg}/R_5 \text{ holds.}$$

Accordingly, the thermal voltage ($V_T$) is expressed by $$V_T=2m(R_4/R_1)V_t \ln(n)-Lm(R_4/R_5)V_{bg}.$$

In the above expression, the first term of the right side is proportional to absolute temperature, and the second term has no temperature dependency.

For example, a temperature coefficient 10 mV/C° is obtained by setting the resistance and mirror ratio values such that the value of $2m(R_4/R_1)\ln(n)$ becomes "118", since the temperature coefficient of $V_t$ is about 0.085 mV/C°. In this case, in the first term of the right side of the above expression, the value is about 3V at room temperature, and in case of temperature rise by 100° C., about 4V. In a case where the power source voltage is 5V, a sufficient dynamic range cannot be attained with respect to the temperature change. Accordingly, the thermal voltage $V_T$ is shifted to the low voltage side by the temperature-independent voltage (the second term of the right side).

Next, the comparator (comp1) compares the thermal voltage $V_T$ with the reference voltages ($V_{ref1}$ to $V_{ref4}$), binarizes the result of comparison, and outputs it as binary data in the binarization circuit. When the thermal voltage ($V_T$) is lower than the reference voltage, the value of output signal ($T_0$) from the comparator (comp1) is "0", while if the thermal voltage is higher than equal to the reference voltage, the value of the output signal is "1".

Figure 4:
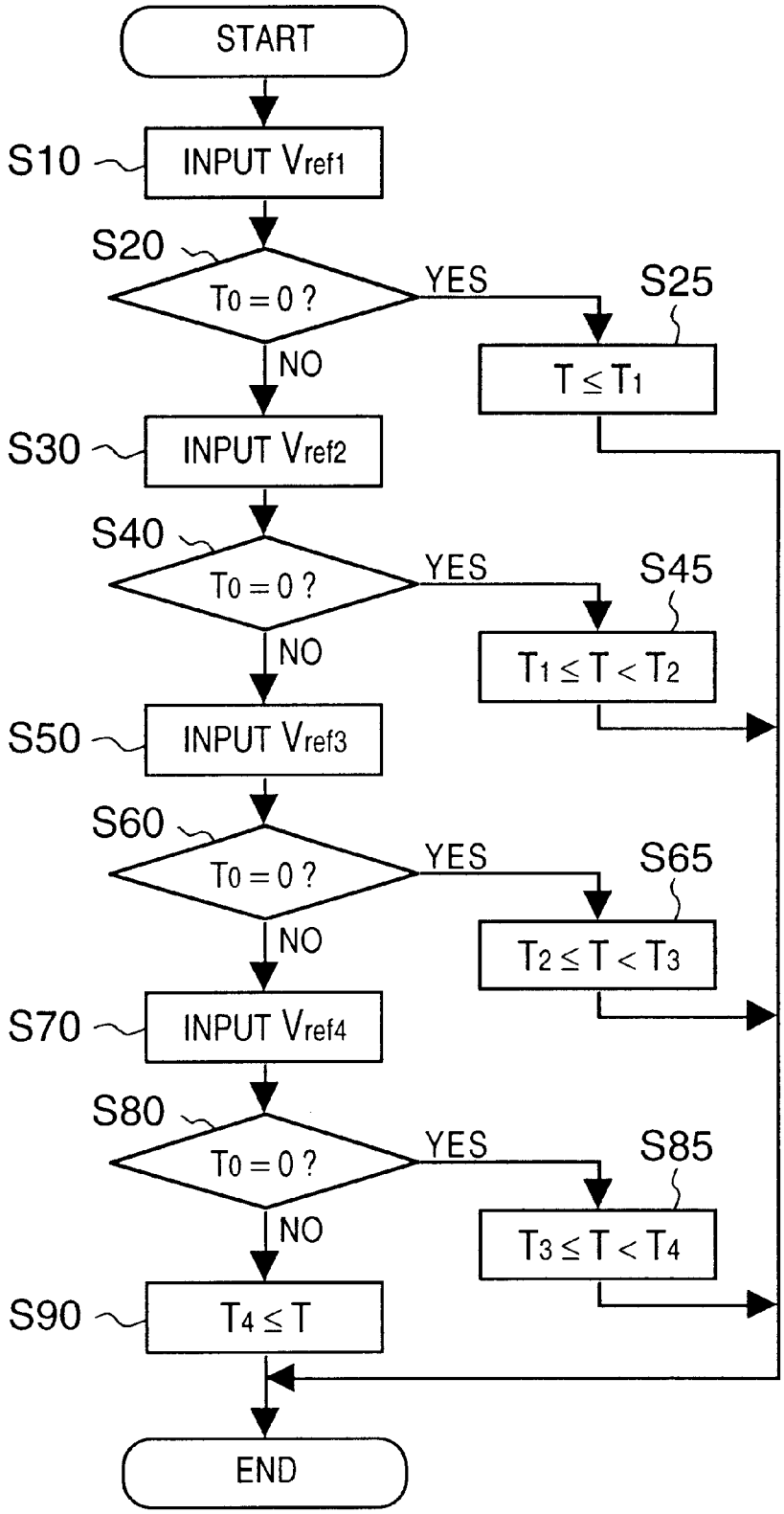
FIG. 4 is a flowchart showing temperature detection processing.

Accordingly, the printing apparatus, using the printhead with the temperature detection circuit having the above construction, performs temperature detection by performing processing according to the flowchart of FIG. 4. Note that as shown in FIG. 3, the printhead has analog switches to control the reference voltages ($V_{ref1}$ to $V_{ref4}$) to be inputted into the comparator (comp1) and input terminals to input control signals to turn ON/OFF the switches. The control signal is inputted via a flexible cable (not shown) from the head driver 1705 into the input terminals.

Further, the reference voltages ($V_{ref1}$ to $V_{ref4}$) respectively correspond to predetermined temperatures $T_1$, $T_2$, $T_3$ and $T_4$ ($T_1<T_2<T_3<T_4$).

First, at step S10, an analog switch 201 is turned ON to input the reference voltage $V_{ref1}$ into the comparator (comp1). Next, at step S20, the value of the output signal ($T_0$) from the comparator (comp1) is examined. If $T_0=0$ holds, the process proceeds to step S25, at which it is determined that $T<T_1$ holds as the internal temperature (T) of the printhead. On the other hand, if $T_0=1$ holds, the process proceeds to step S30.

At step S30, an analog switch 202 is turned ON to input the reference voltage $V_{ref2}$ into the comparator (comp1). Next, at step S40, the value of the output signal ($T_0$) from the comparator (comp1) is examined. If $T_0=0$ holds, the process proceeds to step S45, at which it is determined that $T_1 \leqq T<T_2$ holds as the internal temperature (T) of the printhead. On the other hand, if $T_0=1$ holds, the process proceeds to step S50.

At step S50, an analog switch 203 is turned ON to input the reference voltage $V_{ref3}$ into the comparator (comp1). Next, at step S60, the value of the output signal ($T_0$) from the comparator (comp1) is examined. If $T_0=0$ holds, the process proceeds to step S65, at which it is determined that $T_2 \leqq T<T_3$ holds as the internal temperature (T) of the printhead. On the other hand, if $T_0=1$ holds, the process proceeds to step S70.

At step S70, an analog switch 204 is turned ON to input the reference voltage $V_{ref4}$ into the comparator (comp1). Next, at step S80, the value of the output signal ($T_0$) from the comparator (comp1) is examined. If $T_0=0$ holds, the process proceeds to step S85, at which it is determined that $T_3 \leqq T<T_4$ holds as the internal temperature (T) of the printhead. On the other hand, if $T_0=1$ holds, the process proceeds to step S90, at which it is determined that $T_4 \leqq T$ holds as the internal temperature (T) of the printhead.

In this manner, the printing apparatus controls the analog switches to sequentially select the reference voltage from different values, inputs the selected reference voltage into the comparator (comp1) of the temperature detection circuit to obtain the binary signal ($T_0$) as the result of comparison, and estimate the temperature of the printhead based on the binary signal value.

Accordingly, in the above-described embodiment, as the temperature information from the printhead can be obtained as digital binary data, it is not necessary to provide an analog processing circuit outside the printhead, further, it is not necessary to provide an A/D converter in the CPU of the controller, as in the conventional printing apparatus. Thus the temperature information can be obtained with a simple and low-cost structure. Further, the digital output from the printhead enhances tolerance against the noise generated by other signal lines in the flexible cable which extends from the digital output to the input to the CPU of the controller. Accordingly, print control can be made based on highly-reliable temperature information.

Note that in the present embodiment, the temperature detection is performed in five ranges corresponding to four reference voltages, however, the present invention is not limited to this arrangement. For example, the temperature detection in higher accuracy can be made by increasing the points of resistance by the resistors $R_{r1}$ to $R_{r4}$.

[Another Embodiment]

Figure 5:
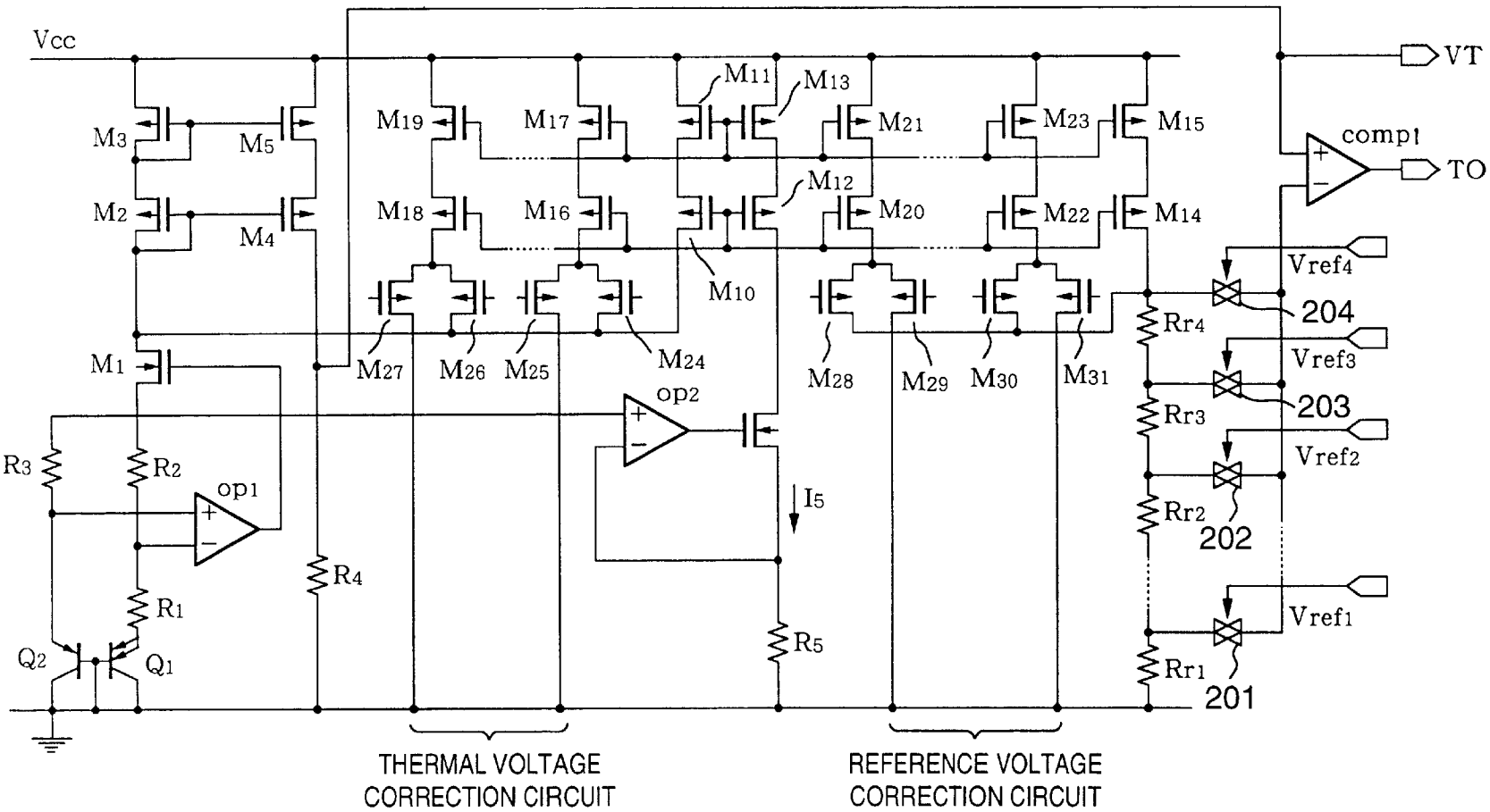
FIG. 5 is a circuit diagram showing the construction of the temperature detection circuit according to another embodiment of the present invention.
Figure 6:
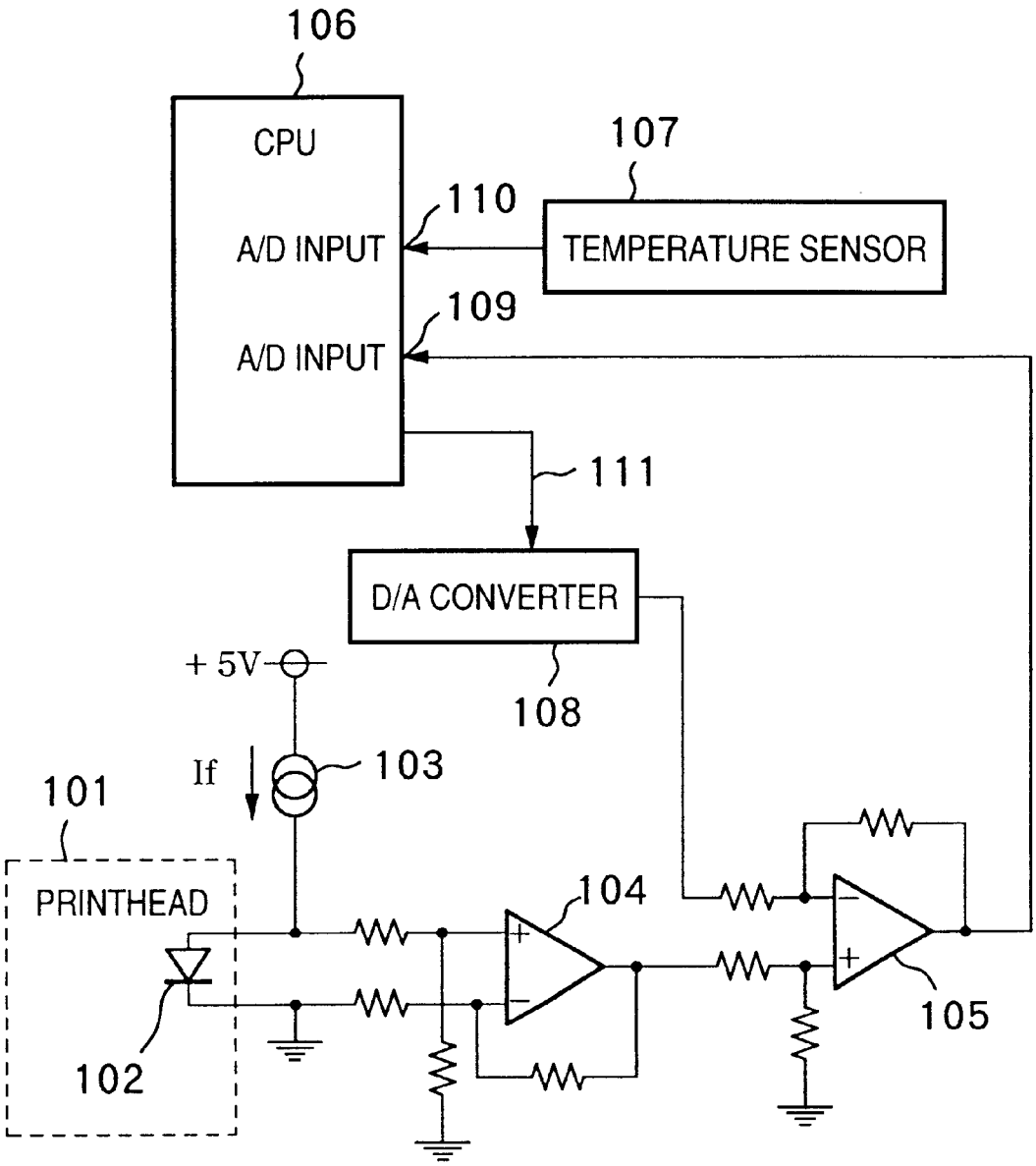
FIG. 6 is a block diagram showing the construction of the conventional temperature detection circuit.

FIG. 5 is a circuit diagram showing the construction of the temperature detection circuit according to another embodiment of the present invention.

The circuit in this figure has correction means for obtaining a desired temperature detection output even in a case where the operational amplifier in FIG. 3 has an input offset voltage or even in a case where the resistance ratio is fluctuated with respect to a designed value.

In FIG. 5, assuming that the input offset voltage at the operational amplifier $OP_1$, is $V_{OS1}$, the bandgap voltage $V_{bg}$ is expressed by $$V_{bg}=V_{be2}+a(V_t+V_{os1}).$$

The offset voltage multiplied by a ($V_{of1}$) becomes an error of the bandgap voltage $V_{bg}$. Further, the fluctuations in the resistance ratio cause fluctuations in a, and cause an error of the bandgap voltage $V_{bg}$. The thermal voltage $V_T$ is expressed by $$V_T=2m(R_4/R_1)(V_t+V_{os1})\ln(n)-Lm(R_4/R_5)\{V_{be2}+a(V_t+V_{os1})\},$$

thus the offset voltage ($V_{os1}$) contributes to an error of the thermal voltage ($V_T$). Further, fluctuations in the respective resistance ratios and the mirror ratios cause an error in the thermal voltage ($V_T$).

For the above error, the reference voltage correction circuit operates as follows.

A correction current proportional to the current $I_5$ which flows through the resistor $R_5$ is passed through the resistors $R_{r1}$ to $R_{r4}$ by a current mirror circuit constructed with MOS transistors $M_{20}$ to $M_{23}$. On the other hand, MOS transistors $M_{28}$ to $M_{31}$ respectively construct differential switches for selection to pass/not to pass the correction current through the resistors $R_{r1}$ to $R_{r4}$.

The current mirror circuit is provided at plural stages, and the current ratio is set to be 2 to the n-th power (n: zero and positive integer)), i.e., $1:2:4:\ldots:2^n$, at the respective stages, so as to obtain an arbitrary correction current value in the resolution of minimum current value, by selection by the switches.

Note that the reference of the correction current is the current $I_5$ that flows through the resistor $R_5$. Since the bandgap voltage $V_{bg}$ is applied to the resistor $R_5$ by the operational amplifier $OP_2$, a voltage proportional to the bandgap voltage $V_{bg}$ can be arbitrarily controlled with regard to the reference voltages ($V_{ref1}$ to $V_{ref4}$) by passing the correction current through the resistors $R_{r1}$ to $R_{r4}$.

Further, a current mirror circuit constructed with MOS transistors $M_{17}$ to $M_{19}$ and a differential switches constructed with MOS transistors $M_{24}$ to $M_{27}$ operate similarly to the reference voltage correction circuit, to arbitrarily control the voltage proportional to the bandgap voltage $V_{bg}$ with regard to the thermal voltage ($V_T$).

Further, it may be arranged such that a storage device such as a fuse ROM is employed for storing information to be used as output to select the differential switches $M_{24}$ to $M_{31}$. In this case, an error due to variations in circuit characteristic is corrected by the correction circuit in advance, and the corrected status may be written into the storage device.

Note that in the above embodiments, the liquid discharged from the printhead has been described as ink, and the liquid contained in the ink tank has been described as ink. However, the liquid is not limited to ink. For example, the ink tank may contain processed liquid or the like discharged to a print medium to improve fixability or water repellency of a printed image or to increase the image quality.

The embodiments described above have exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open Publication No. 59-123670 which discloses the arrangement using a slot common to a plurality of electrothermal transducers as a discharge portion of the electrothermal transducers, or Japanese Patent Laid-Open Publication No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main body and can receive an ink from the apparatus main body upon being mounted on the apparatus main body can be employed as well as a cartridge type printhead in which an ink tank is integrally arranged on the printhead itself as described in the above embodiments.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In the present invention, the above-mentioned film boiling method is most effective for the above-mentioned inks.

In addition, the ink-jet printer of the present invention may be used in the form of a copying machine combined with a reader and the like, or a facsimile apparatus having a transmission reception function in addition to an image output terminal of an information processing apparatus such as a computer.

The present invention can be applied to a system constituted by a plurality of devices (e.g., a host computer, an interface, a reader and a printer) or to an apparatus comprising a single device (e.g., a copy machine or a facsimile apparatus).

Further, the object of the present invention can be also achieved by providing a storage medium storing program code for performing the aforesaid processes to a system or an apparatus, reading the program code with a computer (e.g., CPU, MPU) of the system or apparatus from the storage medium, then executing the program. In this case, the program code read from the storage medium realizes the functions according to the embodiments, and the storage medium storing the program code constitutes the invention. Furthermore, besides aforesaid functions according to the above embodiments are realized by executing the program code which is read by a computer, the present invention includes a case where an OS (operating system) or the like working on the computer performs a part or entire processes in accordance with designations of the program code and realizes functions according to the above embodiments.

Furthermore, the present invention also includes a case where, after the program code read from the storage medium is written in a function expansion card which is inserted into the computer or in a memory provided in a function expansion unit which is connected to the computer, CPU or the like contained in the function expansion card or unit performs a part or entire process in accordance with designations of the program code and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A printhead comprising:

a driving circuit that drives printing elements; and a detection circuit that detects a temperature and outputs information on the temperature as a digital output, wherein said driving circuit and said detection circuit are integrated on a same semiconductor substrate, wherein said detection circuit includes:

a first circuit that generates a temperature-independent bandgap voltage;

a second circuit that amplifies the bandgap voltage generated by said first circuit and generates a reference voltage;

a third circuit voltage that generates a thermal voltage proportional to an absolute temperature; and a fourth circuit that compares the thermal voltage with the reference voltage, and outputs the result of comparison as binary data.

2. The printhead according to claim 1, wherein said second circuit includes plural resistors serially connected to an output of the reference voltage so as to output plural different voltages among said plural resistors.

3. The printhead according to claim 2, wherein the plural different voltages are sequentially selected and outputted to said fourth circuit.

4. The printhead according to claim 1, wherein said printhead is an ink-jet printhead that performs printing by discharging ink.

5. The printhead according to claim 4, wherein said printing elements comprise electrothermal transducers to generate thermal energy to be supplied to the ink for discharging the ink.

6. The printhead according to claim 1, further comprising:

a fifth circuit that corrects the reference voltage and the thermal voltage; and holding means for holding information corrected by said fifth circuit.

7. The printhead according to claim 6, wherein said holding means comprises a fuse ROM.

8. A printing apparatus that performs printing by using the printhead in any of one of claims 1 to 7.

* * * * *

UNITED STATES PATENT AND TRADEMARK OFFICE

CERTIFICATE OF CORRECTION

PATENT NO. : 6,505,904 B1
DATED : January 14, 2003
INVENTOR(S) : Hirayama

It is certified that error appears in the above-identified patent and that said Letters Patent is hereby corrected as shown below:

Title page,
Item [*] Notice, "by 44 days." should read -- by 0 days. --.
Item [57], ABSTRACT,
Line 1, "having" should read -- has --.
Line 4, "using" should read -- uses --.

Column 1,
Line 16, "in non-uniformed" should read -- of non-uniform --.
Line 28, "is" should read -- includes --.
Line 29, "temperature," should read -- temperature and --.
Line 32, "is" should read -- involves --.
Line 42, "$V_f$" should read -- $V_F$ --.

Column 3,
Line 12, "comprising:" should read -- comprises --.
Line 14, "voltage;" should read -- voltage --.
Line 35, "a" should read -- an --.

Column 4,
Line 64, "the manner" should read -- a manner --.

Column 5,
Line 1, "shown) e.g." should read -- shown), e.g., --.
Line 37, "device ) 15" should read -- device) 15 --.
Line 38, "These" should read -- The --.

Column 6,
Line 63, "a" (first occurrence) should read -- an --.

Column 9,
Line 41, "estimate" should read -- estimates --.

Column 10,
Line 48, "a" should be deleted.

Column 12,
Line 52, "transmission reception" should read -- transmission/reception --.

Column 13,
Line 5, "embodiments are" should read -- embodiments being --.
Line 8, "or" should read -- of or --.

UNITED STATES PATENT AND TRADEMARK OFFICE

CERTIFICATE OF CORRECTION

PATENT NO. : 6,505,904 B1 
DATED : January 14, 2003
INVENTOR(S) : Hirayama

It is certified that error appears in the above-identified patent and that said Letters Patent is hereby corrected as shown below:

Column 14,
Line 4, "voltage" should be deleted.
Line 35, "any of" should read -- any --.

Signed and Sealed this

Sixteenth Day of December, 2003

JAMES E. ROGAN
*Director of the United States Patent and Trademark Office*